US011341950B2

(12) United States Patent
Kalinichenko et al.

(10) Patent No.: US 11,341,950 B2
(45) Date of Patent: May 24, 2022

(54) METHOD AND DEVICE FOR GENERATING ACOUSTIC COMPENSATION SIGNALS

(71) Applicant: ASK Industries GmbH, Niederwinkling (DE)

(72) Inventors: Victor Kalinichenko, Viechtach (DE); Denis Perechnev, Schwarzach (DE)

(73) Assignee: ASK Industries GmbH, Niederwinkling (DE)

( * ) Notice: Subject to any disclaimer, the term of this patent is extended or adjusted under 35 U.S.C. 154(b) by 0 days.

(21) Appl. No.: 17/273,421

(22) PCT Filed: Sep. 12, 2018

(86) PCT No.: PCT/EP2018/074673
§ 371 (c)(1),
(2) Date: Mar. 4, 2021

(87) PCT Pub. No.: WO2020/052757
PCT Pub. Date: Mar. 19, 2020

(65) Prior Publication Data
US 2021/0201882 A1 Jul. 1, 2021

(51) Int. Cl.
*G10K 11/178* (2006.01)

(52) U.S. Cl.
CPC .. *G10K 11/17827* (2018.01); *G10K 11/17883* (2018.01); *G10K 11/17885* (2018.01);
(Continued)

(58) Field of Classification Search
CPC ..... G10K 11/17827; G10K 11/17885; G10K 11/17883; G10K 2210/1282; G10K 2210/3032; G10K 2210/503
(Continued)

(56) References Cited

U.S. PATENT DOCUMENTS

2005/0207585 A1* 9/2005 Christoph ..... G10K 11/17883 381/71.11

FOREIGN PATENT DOCUMENTS

| | | |
|---|---|---|
| EP | 1577879 A1 | 9/2005 |
| EP | 2189974 A2 | 5/2010 |
| EP | 2351019 A1 | 8/2011 |

OTHER PUBLICATIONS

International Search Report and Written Opinion pertaining to PCT/EP2018/074673, dated Jun. 24, 2019.

* cited by examiner

*Primary Examiner* — Paul Kim
*Assistant Examiner* — Douglas J Suthers
(74) *Attorney, Agent, or Firm* — Dinsmore & Shohl LLP

(57) ABSTRACT

Disclosed herein are methods for operating an apparatus for generating acoustic compensation signals used to compensate acoustic signals from operation of a motor-vehicle engine, comprising the steps: providing an EOC device, which is designed to generate acoustic compensation signals used to compensate acoustic signals that result from the operation of the engine; providing a device configured using the EOC device as a model; determining at least one audio signal to be output into a passenger compartment of a motor vehicle by means of an audio output device, before said audio signal is captured by an audio capturing element associated with the EOC device; applying an evaluation specification to evaluate the at least one audio signal with respect to at least one evaluation criterion; generating evaluation information with respect to the at least one evaluation criterion; controlling the operation of the EOC device on the basis of the evaluation Information.

20 Claims, 2 Drawing Sheets

(52) U.S. Cl.
CPC ..... *G10K 2210/1282* (2013.01); *G10K 2210/3032* (2013.01); *G10K 2210/503* (2013.01)

(58) Field of Classification Search
USPC ..... 381/71.1
See application file for complete search history.

METHOD AND DEVICE FOR GENERATING ACOUSTIC COMPENSATION SIGNALS

CROSS REFERENCE TO RELATED APPLICATIONS

The present specification is a National Phase Entry of International Application No. PCT/EP2018/074673 filed Sep. 12, 2018 and entitled "Method and Device for Generating Acoustic Compensation Signals" the entirety of which is incorporated by reference herein.

FIELD

The present specification relates to a method for operating an apparatus for generating acoustic compensation signals, which are used to compensate acoustic signals that result from the operation of a motor-vehicle drive engine.

BACKGROUND

Corresponding methods are known in principle from the field of motor vehicle technology, in particular in conjunction with the use of what are known as Engine Order Cancellation devices, EOC devices for short.

In this case, control of the operation of corresponding EOC devices which is satisfactory with respect to the compensation result is a challenge, because other audio signals ("external noise") are output, in addition to the compensation signals, inside the vehicle interior, typically defined by the passenger compartment, e.g. inside the space in which corresponding compensation signals, used for compensating acoustic signals which result from the operation of a motor-vehicle drive engine. Occasionally, instabilities in the operation of the EOC device may occur, on account of the acoustic situation within the vehicle interior defined by the output of corresponding other audio signals.

Accordingly, the operation of corresponding EOC devices is to be controlled, for a specific acoustic situation within a vehicle interior, such that the EOC device can be operated in as stable a manner as possible. Furthermore, as far as possible only the acoustic signals that are actually to be compensated, i.e. the acoustic signals which result from the operation of the motor-vehicle drive engine, are compensated and the remaining audio signals as far as possible are not compensated.

SUMMARY

The object of the present specification is that of specifying a method, improved in comparison therewith, for operating an apparatus for generating acoustic compensation signals, which are used to compensate acoustic signals that result from the operation of a motor-vehicle drive engine.

This object is achieved by a method according to claim 1. The dependent claims relate to possible embodiments of the method according to claim 1. The method described herein is used, in general, for operating an apparatus for generating acoustic compensation signals, which are used to compensate acoustic signals (intended to mean in particular acoustic interfering signals, such as speed-dependent and/or load-dependent vibrations of a specific harmonic order) that result from the operation of a motor-vehicle drive engine, i.e. typically an internal combustion engine. As is clear in the following, the method in particular includes the control of the operation of a motor-vehicle engine order cancellation device, EOC device for short, such that the method can optionally also be referred to or considered a method for controlling the operation of a motor-vehicle EOC device.

The method includes the steps which are explained in greater detail in the following:

In a first step of the method, an EOC device which is implemented by hardware and/or software and is to be operated (according to the method) is provided. The EOC device is designed, in a manner known per se, to generate acoustic compensation signals, which are used to compensate acoustic signals that result from the operation of a motor-vehicle drive engine, i.e. typically an internal combustion engine, in a vehicle interior typically defined by a passenger compartment. The EOC device comprises, in a manner known per se, at least one audio capturing element, i.e. for example a microphone, and at least one audio output element, i.e. for example a loudspeaker. The provision of the EOC device which takes place in the first step typically does not mean that the EOC device is already brought into operation in the first step. Therefore, typically no corresponding compensation signals are yet generated by the EOC device in the first step.

In a second step of the method, a device, implemented by hardware and/or software, is provided which is designed in a manner modeled (largely identically or completely identically) on the EOC device. Therefore, in the second step of the method, a device is provided which is designed using the EOC device as a model, i.e. typically has the same functionality as the EOC device. The device may be a (virtual) copy of the EOC device. The device can therefore be designed having the same operating or tuning parameters as the EOC device. The device can therefore in particular have the same tuning parameters as the EOC device. Specifically, it is therefore possible, for example, for the same drive motor speed-dependent or drive motor load-dependent engine oscillations or orders, the same forgetting factor $\lambda$ or the same adaptation step size $\mu$ to be stored in the device. The device can in particular also have the same bandwidth and the same transient behavior as the EOC device. The device can optionally be referred to or considered a (virtual) second EOC device.

Expediently, a device is used which comprises an audio output element, i.e. for example a (virtual) loudspeaker, which is directly acoustically coupled to an audio capturing element, i.e. for example a (virtual) microphone. A direct acoustic coupling is intended to mean in particular that the output of the audio output element of the device is directly coupled or connected to the input of the audio capturing element of the device. Such a (virtually) directly coupled configuration of the device or the audio output and audio capturing elements of the device makes it possible for the method to be carried out in a manner having a significant time advantage. In this case, psychoacoustic masking effects can be used or taken into account.

In a third step of the method, at least one audio signal, to be output via an audio output device which is located in a passenger compartment of a motor vehicle and comprises one or more audio output elements, i.e. typically loudspeakers, is determined. It is essential for the determination of the at least one audio signal to take place before said signal is captured by an audio capturing element, i.e. for example a microphone, associated with the EOC device, or is recorded by an audio capturing element, i.e. for example a microphone, associated with the EOC device. The determination of the at least one audio signal therefore typically takes place before said audio signal reaches an audio capturing element associated with the EOC device. In particular, the determination of the at least one audio signal can take place before the at least one audio signal is actually output into the passenger compartment via the audio output device. According to the method, accordingly, in the third step, information is collected relating to all those audio signals which would be output into the passenger compartment of the motor vehicle or are output into the passenger compartment of the motor vehicle at a later time. In this way, the acoustic situation within the passenger compartment defined by corresponding audio signals can be determined early or prematurely (in a simulative or virtual manner), i.e. before these are captured by an audio capturing element associated with the EOC device, in particular before actually being output into the passenger compartment by means of the output of the audio signals. In the actual operation of the EOC device, compensation signals for compensating corresponding acoustic signals to be compensated are generated by the EOC device, in the acoustic situation. The determination can be carried out by means of a determination device implemented by hardware and/or software, which is designed for determining at least one audio signal which is to be output into a passenger compartment of a motor vehicle by means of an audio output device comprising one or more audio output elements.

Corresponding audio signals that are to be output into the passenger compartment may for example be acoustic multimedia or infotainment signals, i.e. for example music, speech, or other sound or sound sequence signals. Corresponding multimedia and/or infotainment signals can be generated for example by means of a motor-vehicle multimedia or infotainment device. Alternatively or in addition, corresponding audio signals to be output into the passenger compartment can also be artificially generated acoustic engine noise signals, i.e. audio signals which reproduce a particular engine type and/or a particular operating state of a particular engine type. Corresponding acoustic engine noise signals can for example be generated by a motor-vehicle engine noise generation device, for example in the form of an engine sound synthesis device, ESS device for short. Thus, in the contest of the method, an audio output device can be used which is or comprises a multimedia or infotainment device for outputting audio content, in particular music or speech, or an engine audio signal generation device for outputting audio content modeled on a particular engine noise.

In principle, a corresponding audio signal to be output into the passenger compartment can also be a compensation signal generated by the EOC device.

The audio signal(s) determined in the third step is/are typically known. Information is therefore present, in particular in the device, which describes the audio signals that are output into the passenger compartment. Therefore, in a third step, typically at least one known audio signal is determined, in particular an audio signal that can be or is generated by means of at least one motor-vehicle audio signal generation device, in particular a multimedia device for generating audio signals that represent multimedia content, or an engine noise generation device for generating audio signals that reproduce a particular engine type and/or a particular operating state of a particular engine type.

In a fourth step of the method, an evaluation specification is applied to evaluate the at least one audio signal to be output into the passenger compartment, with respect to at least one evaluation criterion. Therefore, in a fourth step, the audio signal(s) to be output into the passenger compartment is/are evaluated or examined with respect to one or more evaluation criteria defined by the evaluation specification. As is clear in the following, the evaluation in particular includes an examination of the audio signals as to whether or not these meet an evaluation criterion. The evaluation specification can be stored in an evaluation device implemented by hardware and/or software. The evaluation can therefore be performed by means of an evaluation device implemented by hardware and/or software, which device is designed to use an evaluation specification to evaluate the at least one audio signal to be output into the passenger compartment, with respect to at least one evaluation criterion.

In the case of a plurality of audio signals to be output by the audio output device, an audio composite signal, formed by summation of the audio signals in question and optionally weighted by at least one weighting parameter, can be formed and used, to which composite signal the evaluation specification is applied. The summation of the relevant audio signals may be advantageous insofar as just one signal, specifically the audio composite signal, has to be considered and processed. The summation of the relevant audio signals can be performed using a summation device implemented by hardware and/or software, which device is designed for summation of the relevant audio signals in order to form a corresponding audio composite signal.

In a fifth step of the method, evaluation information describing the evaluation of the at least one audio signal with respect to the at least one evaluation criterion is generated. The result of the evaluation of the at least one audio signal, performed or being performed in the fourth step, is therefore reproduced in corresponding evaluation information in a fifth step. The evaluation information can be generated by the or a corresponding evaluation device implemented by hardware and/or software, which device is designed for generating evaluation information describing the evaluation of the at least one audio signal with respect to the evaluation criterion.

In a sixth step of the method, the operation of the EOC device is controlled in order to generate acoustic compensation signals, which are used to compensate acoustic signals that result from the operation of a motor-vehicle drive engine, on the basis of the evaluation information. The evaluation information generated in the fifth step can therefore form the basis for generating control information that is to form the basis of the actual operation of the EOC device. The control of the operation of the EOC device can take place by means of a central or decentralized controller, implemented by hardware and/or software, which is designed for controlling the operation of the EOC device on the basis of the evaluation information.

The control of the operation of the EOC device can be carried out for example on the basis of the evaluation information, by adjusting at least one operating or tuning parameter, in particular a $\lambda$- or $\mu$-parameter, i.e. the forgetting factor $\lambda$ or the adaptation step size $\mu$, of the EOC device. In particular, the control of the operation of the EOC device can be carried out by adjusting at least one operating or tuning parameter, in particular a $\lambda$- or $\mu$-parameter, of the EOC device for at least one drive motor speed-dependent and/or drive motor load-dependent harmonic engine oscillation or order, in particular specified by means of at least one tuning parameter of the EOC device. Therefore, individual adjustment of operating parameters for respective drive motor speed-dependent and/or drive motor load-dependent harmonic engine oscillations or orders can take place. In all cases, the adjustment of the operating parameters of the EOC device is expediently performed prior to the generation and output of respective compensation signals.

The method therefore allows for control of the operation of an EOC device on the basis of an early or premature determination and evaluation of typically known audio signals which are intended to be output into a passenger compartment, into which passenger compartment the compensation signals generated by the EOC device are also intended to be output. It is essential in this case for the determination and evaluation of the audio signals to take place before said audio signals are captured by an audio capturing element, i.e. for example a microphone, associated with the EOC device, or is recorded by an audio capturing element, i.e. for example a microphone, associated with the EOC device. The determination and evaluation of the audio signals can in particular take place before said audio signals are actually output into the passenger compartment. The determination and evaluation of the audio signals typically also takes place prior to corresponding compensation signals being output into the passenger compartment. In this way, the risk of interaction between the compensation signals and the remaining audio signals to be output or having been output into the passenger compartment, which interaction has a negative impact on the stability of the operation of the EOC device and thus on the compensation result, is reduced. Similarly it is possible to ensure that (as far as possible) only the acoustic signals that are actually to be compensated, i.e. the acoustic signals which result from the operation of the motor-vehicle drive engine, are compensated and the remaining audio signals (as far as possible) are not compensated.

Thus, an improved method for operating an apparatus for generating acoustic compensation signals, which are used to compensate acoustic signals that result from the operation of a motor-vehicle drive engine, is provided.

The determination of the at least one audio signal to be output into the passenger compartment of the motor vehicle by means of the audio output device, before said audio signal is captured by an audio capturing element, i.e. for example a microphone, associated with the EOC device, in particular before said audio signal is output into the passenger compartment by means of the audio output device, can be achieved by means of the device modeled on the EOC device. The device can therefore be designed as or comprise a corresponding determination device. This can simplify the design of an apparatus for carrying out the method, as the device comprises a plurality of functionalities that are necessary or expedient for carrying out the method.

The determination of the at least one audio signal that is to be output into a passenger compartment via the audio output device can for example comprise determination of the acoustic properties of the audio signal. Therefore, in particular transient, acoustic properties such as amplitudes or amplitude curves, frequencies or frequency curves, energies or energy curves, etc., of the audio signal can be determined. Similar applies for a corresponding audio composite signal.

The evaluation specification can include an evaluation of the at least one audio signal with regard to whether the audio signal comprises audio signal portions at drive motor speed-dependent and/or drive motor load-dependent harmonic engine oscillations or orders, in particular specified by at least one tuning parameter of the EOC device. The at least one audio signal can therefore be evaluated or examined with regard to whether it comprises audio signal portions at drive motor speed-dependent and/or drive motor load-dependent harmonic engine oscillations or orders, in particular specified by at least one tuning parameter of the EOC device.

In particular, the evaluation specification can include an evaluation of the at least one audio signal with regard to whether the audio signal comprises frequency components or curves which correspond to or correlate with drive motor speed-dependent and/or drive motor load-dependent frequency components of harmonic engine oscillations or orders, in particular specified by at least one tuning parameter of the EOC device. The at least one audio signal can therefore be evaluated or examined with regard to whether it comprises frequency components or curves which correspond to or correlate with frequency components of drive motor speed-dependent and/or drive motor load-dependent harmonic engine oscillations or orders, in particular specified by at least one tuning parameter of the EOC device.

The evaluation criterion can therefore be or comprise for example at least one frequency component or a (time-dependent) frequency curve which is evaluated or examined with respect to at least one drive motor speed-dependent and/or drive motor load-dependent harmonic engine oscillation or order, in particular specified by at least one tuning parameter of the EOC device. In particular, the evaluation criterion can be or comprise at least one, in particular time-dependent, frequency component which is evaluated or examined with respect to at least one drive motor speed-dependent and/or drive motor load-dependent harmonic engine oscillation or order, in particular specified by at least one tuning parameter of the EOC device.

The evaluation specification can furthermore include an evaluation of the amplitude, i.e. in particular an upper and/or lower limit amplitude, of the or a corresponding frequency component, which frequency component corresponds to drive motor speed-dependent and/or drive motor load-dependent frequency components of harmonic engine oscillations or orders, in particular specified by at least one tuning parameter of the EOC device. A frequency component which corresponds to a frequency component of a harmonic engine oscillation or order can thus be evaluated with respect to the amplitude thereof.

The present specification further relates to an apparatus for generating acoustic compensation signals, which are used to compensate acoustic signals that result from the operation of a motor-vehicle drive engine.

The apparatus comprises an EOC device implemented by hardware and/or software, which is designed for generating acoustic compensation signals that result from the operation of a motor-vehicle drive engine; a device implemented by hardware and/or software that is configured using the EOC device as a model; an audio output device implemented by hardware and/or software which is designed for outputting audio signals into a passenger compartment of a motor vehicle; a determination device implemented by hardware and/or software which is designed for determining at least one audio signal that is to be output into a passenger compartment via the audio output device before said audio signal is captured by an audio capturing element, i.e. for example a microphone, associated with the EOC device, in particular before said audio signal is output into the passenger compartment by the audio output device; an evaluation device implemented by hardware and/or software which is designed for applying an evaluation specification for evaluating the audio signal with respect to at least one evaluation criterion, and for generating evaluation information that describes the evaluation of the audio signal with respect to the evaluation criterion; as well as a controller implemented by hardware and/or software which is designed for controlling the operation of the EOC device on the basis of the evaluation information.

The device is expediently connected or formed between the audio output device and the EOC device, in particular between an output of the audio output device and an input of the EOC device.

The device expediently comprises at least one audio capturing element and at least one audio output element, wherein the at least one audio output element is directly acoustically coupled to the at least one audio capturing element. Individual ones of, a plurality of, or all the devices of the apparatus can be functionally and/or structurally united in a common control unit of the apparatus, implemented by hardware and/or software.

All the explanations in connection with the method apply analogously for the apparatus.

The present specification further relates to a motor vehicle, i.e. in particular a passenger car, which comprises at least one apparatus as described herein. Therefore, all the explanations in connection with the apparatus and the method also apply analogously for the motor vehicle.

BRIEF DESCRIPTION OF THE DRAWINGS

Embodiments of the present specification are described in greater detail in the figures, in which.

DETAILED DESCRIPTION

Figure 1:
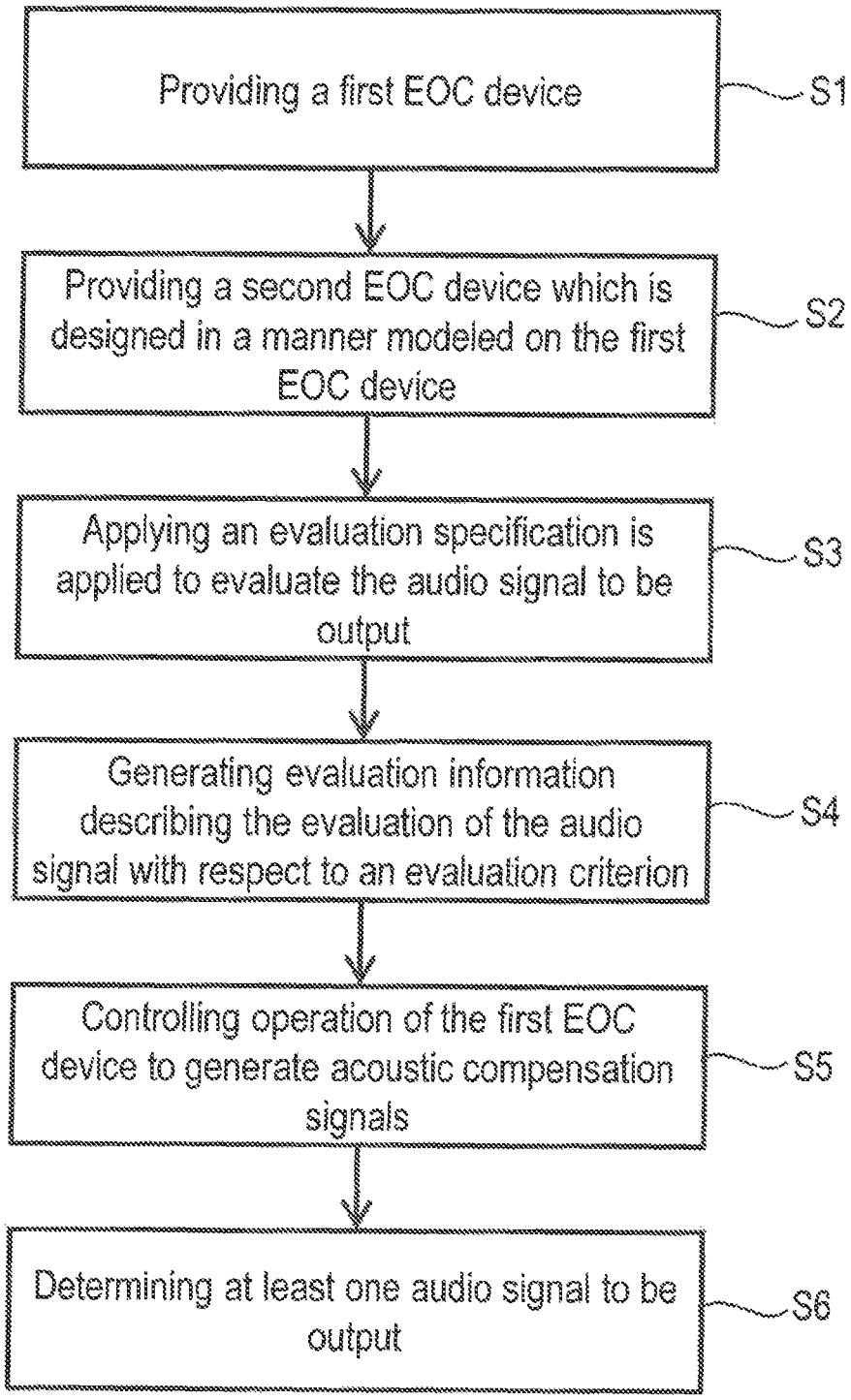
FIG. 1 is a schematic view of a flow diagram for illustrating a method according to an embodiment.

FIG. 1 is a schematic view of a flow diagram for illustrating a method according to an embodiment. The method is used for operating an apparatus 1 for generating acoustic compensation signals, which are used to compensate acoustic signals 3 (intended to mean in particular acoustic interfering signals, such as speed-dependent and/or load-dependent vibrations of a specific harmonic order) that result from the operation of a motor-vehicle drive engine 4, i.e. typically an internal combustion engine.

Figure 2:
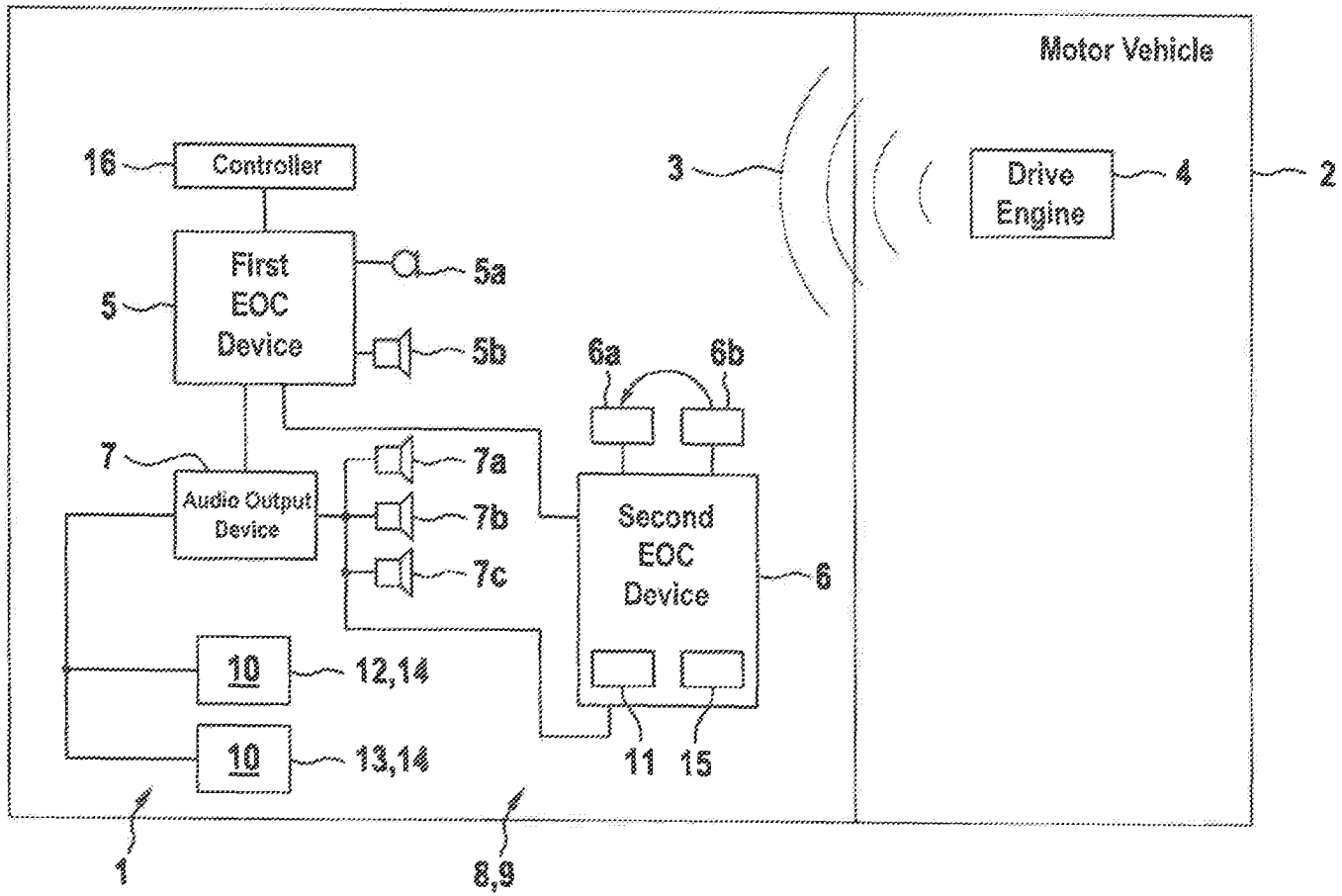
FIG. 2 is a schematic view of an embodiment of an apparatus for carrying out the method illustrated in FIG. 1.

FIG. 2 is a schematic view of an embodiment of an apparatus 1 for carrying out the method illustrated in FIG. 1. The apparatus 1 is installed in a motor vehicle 2, i.e. typically a passenger car, which is shown purely schematically.

The method includes the steps which are explained in greater detail in the following:

In a first step S1 of the method, an EOC device 5 which is implemented by hardware and/or software is provided. The EOC device 5 is designed, in a manner known per se, to generate acoustic compensation signals, which are used to compensate corresponding acoustic signals 3 that result from the operation of the drive engine 4, in a vehicle interior 9 typically defined by the passenger compartment 8 of the motor vehicle 2. The EOC device 5 comprises, in a manner known per se, at least one audio capturing element 5*a*, i.e. for example a microphone, and at least one audio output element 5*b*, i.e. for example a loudspeaker. The provision of the EOC device 5 which takes place in the first step does not mean that the EOC device 5 is already brought into operation in the first step. Therefore, typically no corresponding compensation signals are yet generated by the EOC device 5 in the first step.

In a second step S2 of the method, a device 6, implemented by hardware and/or software, is provided which is designed in a manner modeled (identically) on the EOC device 5. Therefore, in the second step S2 of the method, a device is provided which is designed using the EOC device 5 as a model, i.e. typically has the same functionality and configuration as the EOC device 5. The device 6 is a (virtual) copy of the EOC device 5. The device 6 is therefore typically designed having the same operating or tuning parameters as the EOC device 5. The device 6 can therefore in particular have the same tuning parameters TP as the EOC device 5. Specifically, it is therefore possible, for example, for the same drive motor speed-dependent or drive motor load-dependent engine oscillations or orders, the same forgetting factor $\lambda$ or the same adaptation step size $\mu$ to be stored in the device 6. The device 6 can in particular also have the same bandwidth and the same transient behavior as the EOC device 5. The device 6 can therefore be referred to or considered a (virtual) second EOC device.

Clearly, a device 6 can be used which comprises an audio output element 6*b*, i.e. for example a (virtual) loudspeaker, which is acoustically directly coupled to an audio capturing element 6*a*, i.e. for example a (virtual) microphone. Such a directly coupled configuration of the audio output and audio capturing elements 6*a*, 6*b* of the device 6 makes it possible for the method to be carried out in a manner having a significant time advantage. In this case, psychoacoustic masking effects can be used or taken into account.

In a third step S3 of the method, at least one audio signal 10, to be output via an audio output device 7 which is located in the passenger compartment 8 of the motor vehicle 2 and comprises one or more audio output elements 7*a*-7*c*, i.e. typically loudspeakers, is determined. Of course, it is also possible for a plurality of audio signals 10 to be determined. What is essential is for the determination of the audio signal(s) 10 to take place before said signal(s) is/are captured by an audio capturing element, i.e. for example a microphone, associated with the EOC device, in particular before said audio signal(s) is/are actually output into the passenger compartment 8 by means of the audio output device 7. According to the method, accordingly, in the third step S3, information is collected relating to all those audio signals 10 which would be output into the passenger compartment 8 of the motor vehicle 2 or are output into the passenger compartment 8 of the motor vehicle 2 at a later time. In this way, the acoustic situation within the passenger compartment 8, defined by corresponding audio signals 10, can be (simulatively or virtually) determined early or prematurely, i.e. before the audio signals 10 are captured by an audio capturing element 5*a* associated with the EOC device 5, in particular before the audio signals 10 are actually output into the passenger compartment 8. In the actual operation of the EOC device 5, compensation signals for compensating corresponding acoustic signals 3 to be compensated are generated by the EOC device 5, in the acoustic situation. The determination can be carried out by means of a determination device 11 implemented by hardware and/or software, which is designed for determining at least one audio signal 10 that is to be output into the passenger compartment 8 of the motor vehicle 2, by means of the audio output device 7. It is clear from the embodiment shown in FIG. 2 that the determination device 11 can form part of the device 6.

Corresponding audio signals 10 that are to be output into the passenger compartment 8 may for example be acoustic multimedia or infotainment signals, i.e. for example music, speech, or other sound or sound sequence signals. Corresponding multimedia and/or infotainment signals can be generated for example by means of a motor-vehicle multimedia or infotainment device 12. Alternatively or in addition, corresponding audio signals 10 to be output into the passenger compartment 8 can also be artificially generated acoustic engine noise signals, i.e. audio signals which reproduce a particular engine type and/or a particular operating state of a particular engine type. Corresponding acoustic engine noise signals can for example be generated by a motor-vehicle engine noise generation device 13, for example in the form of an engine sound synthesis device, ESS device for short.

In principle, a corresponding audio signal 10 to be output into the passenger compartment 8 can also be a compensation signal generated by the EOC device 5.

The audio signal(s) 10 determined in the third step S3 is/are known. Information is therefore present in the apparatus 1, in particular in the device 6, which describes the audio signals 10 that are output into the passenger compartment 8. Therefore, in the third step S3, at least one known audio signal 10 is determined, which audio signal in particular can be or is generated by means of a motor-vehicle audio signal generation device 14, i.e. for example the in particular one multimedia or infotainment device 12 and/or the engine noise generation device 13.

In a fourth step S4 of the method, an evaluation specification is applied to evaluate the audio signal(s) 10 to be output into the passenger compartment 8, with respect to at least one evaluation criterion. Therefore, in a fourth step S4, the audio signal(s) 10 to be output into the passenger compartment 8 is/are evaluated or examined with respect to one or more evaluation criteria defined by the evaluation specification. As is clear in the following, the evaluation in particular includes an examination of the audio signals 10 as to whether or not these meet an evaluation criterion. The evaluation specification is stored in an evaluation device 15 implemented by hardware and/or software. The evaluation can therefore be performed by means of an evaluation device 15 implemented by hardware and/or software, which device is designed to use an evaluation specification to evaluate the audio signals 10 to be output into the passenger compartment 8, with respect to at least one evaluation criterion. It is clear from the embodiment shown in FIG. 2 that the evaluation device 15 can form part of the device 6.

The evaluation specification can include an evaluation of the audio signals 10 or a corresponding audio composite signal with regard to whether said signal(s) comprise(s) audio signal portions at drive motor speed-dependent and/or drive motor load-dependent harmonic engine oscillations or orders, in particular specified by at least one tuning parameter TP of the EOC device 5. The audio signals 10 or a corresponding audio composite signal can therefore be evaluated or examined with regard to whether they/it comprise(s) drive motor speed-dependent or drive motor-load dependent harmonic engine oscillations or orders, in particular specified by means of at least one tuning parameter TP of the EOC device 5.

In particular, the evaluation specification can include an evaluation of the audio signals 10 or a corresponding audio composite signal with regard to whether said signal(s) comprise(s) frequency components which correspond to or correlate with drive motor speed-dependent and/or drive motor load-dependent frequency components of harmonic engine oscillations or orders, in particular specified by at least one tuning parameter TP of the EOC device 5. The audio signals 10 or a corresponding audio composite signal can therefore be evaluated or examined with regard to whether they/it comprise(s) frequency components which correspond to or correlate with frequency components of drive motor speed-dependent and/or drive motor load-dependent harmonic engine oscillations or orders, in particular specified by at least one tuning parameter TP of the EOC device 5.

The evaluation criterion can therefore be or comprise for example at least one frequency component which is evaluated or examined with respect to at least one drive motor speed-dependent and/or drive motor load-dependent harmonic engine oscillation or order, in particular specified by at least one tuning parameter TP of the EOC device 5. In particular, the evaluation criterion can therefore be or comprise a frequency component which is evaluated or examined with respect to at least one frequency component of at least one drive motor speed-dependent and/or drive motor load-dependent harmonic engine oscillation or order, in particular specified by at least one tuning parameter TP of the EOC device 5.

In the case of a plurality of audio signals 10 to be output by the audio output device 7, an audio composite signal, formed by summation of the audio signals 10 in question and optionally weighted by at least one weighting parameter, can be formed and used, to which composite signal the evaluation specification is applied. The summation of the relevant audio signals 10 can be performed using a summation device (not shown) implemented by hardware and/or software, which device is designed for summation of the relevant audio signals 10 in order to form a corresponding audio composite signal. The summation device can likewise form part of the device 6.

In a fifth step S5 of the method, evaluation information describing the evaluation of the audio signal(s) 10 with respect to the evaluation criterion is generated. The result of the evaluation of the audio signal(s) 10, performed or being performed in the fourth step S4, is therefore reproduced in corresponding evaluation information in a fifth step S5. The evaluation information can be generated by the evaluation device 15, which is designed for generating evaluation information describing the evaluation of the at least one audio signal with respect to the evaluation criterion.

In a sixth step S6 of the method, the operation of the EOC device 5 is controlled in order to generate acoustic compensation signals, which are used to compensate the acoustic signals 3 that result from the operation of a drive engine 4, on the basis of the evaluation information. The evaluation information generated in the fifth step S5 can therefore form the basis for generating control information that is to form the basis of the actual operation of the EOC device 5. The control of the operation of the EOC device 5 can take place by means of a central or decentralized controller, implemented by hardware and/or software, which is designed for controlling the operation of the EOC device 5 on the basis of the evaluation information. In the embodiment shown in FIG. 2, the control of the operation of the EOC device 5 is carried out, by way of example, by means of a controller 16 associated with the EOC device 5.

The control of the operation of the EOC device 5 can be carried out on the basis of the evaluation information, by adjusting at least one operating or tuning parameter, in particular a $\lambda$- or $\mu$-parameter, i.e. the forgetting factor $\lambda$ or the adaptation step size $\mu$, of the EOC device 5. In particular, the control of the operation of the EOC device 5 can be carried out by adjusting at least one operating parameter, in particular a $\lambda$- or $\mu$-parameter, of the EOC device 5 for at least one drive motor speed-dependent and/or drive motor load-dependent harmonic engine oscillation or order, in particular specified by means of at least one tuning parameter TP of the EOC device 5. Therefore, individual adjustment of operating and/or tuning parameters for respective drive motor speed-dependent and/or drive motor load-dependent harmonic engine oscillations or orders can take place. In all cases, the adjustment of the operating parameters of the EOC device 5 is performed prior to the generation and output of respective compensation signals.

The method allows for control of the operation of an EOC device 5 on the basis of an early or premature determination and evaluation of known audio signals 10 which are intended to be output into the passenger compartment 8, into which passenger compartment the compensation signals generated by the EOC device 5 are also intended to be output. What is essential in this case is for the determination and evaluation of the audio signals 10 to take place before said signals re captured by an audio capturing element 5*a*, i.e. for example a microphone, associated with the EOC device 5, in particular before said audio signals 10 are actually output into the passenger compartment 8. The determination and evaluation of the audio signals 10 also takes place prior to corresponding compensation signals being output into the passenger compartment 8. In this way, the risk of interaction between the compensation signals and the remaining audio signals 10 to be output or having been output into the passenger compartment 8, which interaction has a negative impact on the stability of the operation of the EOC device 5 device and thus on the compensation result, is reduced. Similarly it is possible to ensure that (as far as possible) only the acoustic signals 3 that are actually to be compensated, i.e. the acoustic signals which result from the operation of the drive engine 4, are compensated and the remaining audio signals 10 (as far as possible) are not compensated.

As indicated, the determination of the audio signals 10 to be output into the passenger compartment 8 via the audio output device 7 can take place, by means of the device 6 modeled on the EOC device 5, before said audio signals are captured by an audio capturing element 5*c* associated with the EOC device 5, in particular before said audio signals are output into the passenger compartment 8 via the audio output device 7.

The determination of the audio signals 10 that is to be output into a passenger compartment 8 via the audio output device 7 can for example comprise determination of the acoustic properties of the audio signals 10. Therefore, in particular transient, acoustic properties such as amplitudes or amplitude curves, frequencies or frequency curves, energies or energy curves, etc., of the audio signals 10 can be determined. Similar applies for a corresponding audio composite signal.

It is clear from the method described in connection with FIG. 1 that the apparatus 1 shown in FIG. 2 comprises the following:

an EOC device (5) implemented by hardware and/or software, which is designed to generate acoustic compensation signals, which are used to compensate acoustic signals 3 that result from the operation of a motor-vehicle drive engine 4;

a device 6 implemented by hardware and/or software, which is configured using the EOC device 5 as a model;

an audio output device 7 implemented by hardware and/or software, which is designed for outputting audio signals 10 into a passenger compartment 8 of a motor vehicle 2;

a determination device 11 implemented by hardware and/or software, which is designed for determining at least one audio signal 10 to be output into a passenger compartment 8 of a motor vehicle 2 by means of an audio output device 7, before said audio signal is captured by an audio capturing element 5*a*, i.e. for example a microphone, associated with the EOC device 5, in particular before said audio signal is output into the passenger compartment 8 by means of the audio output device 7;

an evaluation device 15 implemented by hardware and/or software, which is designed to use an evaluation specification to evaluate the at least one audio signal 10 with respect to at least one evaluation criterion, and to generate evaluation information which describes the evaluation of the at least one audio signal 10 with respect to the evaluation criterion; and a controller 16 implemented by hardware and/or software, which is designed for controlling the operation of the EOC device 5 on the basis of the evaluation information.

It is furthermore clear from FIG. 2 that the device 6 can be connected or formed between the audio output device 7 and the EOC device 5, in particular between an output of the audio output device 7 and an input of the EOC device 5.

The invention claimed is:

1. A method for operating an apparatus for generating acoustic compensation signals, which are used to compensate acoustic signals that result from operation of a motor-vehicle drive engine, comprising:

providing a first engine order cancellation (EOC) device, which is designed to generate the acoustic compensation signals, which are used to compensate the acoustic signals that result from the operation of the motor-vehicle drive engine, wherein the first EOC device comprises at least one first audio capturing element and at least one audio output element;

providing a second EOC device configured using the first EOC device as a model, wherein the second EOC device is modeled based on the first EOC device, represents a virtual copy of the first EOC device, and has the same functionality as the first EOC device;

determining at least one audio signal to be output into a passenger compartment of a motor vehicle by means of an audio output device, before the at least one audio signal is captured by the at least one first audio capturing element associated with the first EOC device;

applying an evaluation specification to evaluate the at least one audio signal with respect to at least one evaluation criterion;

generating evaluation information describing an evaluation of the at least one audio signal with respect to the at least one evaluation criterion; and controlling the operation of the first EOC device for generating the acoustic compensation signals, which are used to compensate the acoustic signals that result from the operation of the motor-vehicle drive engine, based on the evaluation information.

2. The method according to claim 1, wherein the determination of the at least one audio signal to be output into the passenger compartment of the motor vehicle by means of the audio output device takes place before the at least one audio signal is output into the passenger compartment via the audio output device.

3. The method according to claim 1, wherein the determination of the at least one audio signal to be output into the passenger compartment of the motor vehicle by means of the audio output device takes place by means of the second EOC device modelled on the first EOC device before the at least one audio signal is captured by the at least one first audio capturing element associated with the first EOC device.

4. The method according to claim 1, wherein the determination of the at least one audio signal that is to be output into the passenger compartment via the audio output device comprises determination of acoustic properties of the at least one audio signal.

5. The method according to claim 1, wherein the evaluation specification includes an evaluation of the at least one audio signal with regard to whether the at least one audio signal comprises audio signal portions at drive motor speed-dependent and/or drive motor load-dependent harmonic engine oscillations or orders specified by at least one tuning parameter of the first EOC device.

6. The method according to claim 5, wherein the evaluation specification includes an evaluation of the at least one audio signal with regard to whether the at least one audio signal comprises frequency components which correspond to drive motor speed-dependent and/or drive motor load-dependent frequency components of harmonic engine oscillations or orders specified by at least one tuning parameter of the first EOC device.

7. The method according to claim 6, wherein the evaluation specification includes an evaluation of an amplitude of the frequency components, which corresponds to drive motor speed-dependent and/or drive motor load-dependent frequency components of harmonic engine oscillations or orders specified by at least one tuning parameter of the first EOC device.

8. The method according to claim 1, wherein the at least one evaluation criterion is or comprises a frequency component which is evaluated with respect to at least one drive motor speed-dependent and/or drive motor load-dependent harmonic engine oscillation or order specified by at least one tuning parameter of the first EOC device.

9. The method according to claim 1, wherein the at least one evaluation criterion is or comprises a frequency component which is evaluated with respect to at least one frequency component specified by at least one tuning parameter of the first EOC device, of at least one drive motor speed-dependent and/or drive motor load-dependent harmonic engine oscillation or order.

10. The method according to claim 1, wherein the second EOC device is used, which is configured having the same operating parameters as the first EOC device.

11. The method according to claim 1, wherein the control of the operation of the first EOC device is carried out based on the evaluation information, by adjusting at least one operating parameter of the first EOC device.

12. The method according to claim 11, wherein the control of the operation of the first EOC device is carried out by adjusting at least one operating parameter of the first EOC device for at least one drive motor speed-dependent and/or drive motor load-dependent harmonic engine oscillation or order specified by means of at least one tuning parameter of the first EOC device.

13. The method according to claim 1, wherein, an audio composite signal, formed by summation of the at least one audio signal, is used, to which the evaluation specification is applied, in response to a plurality of audio signals to be output by the audio output device.

14. The method according to claim 1, wherein the second EOC device is used which comprises an audio output element that is directly acoustically coupled to at least one second audio capturing element.

15. The method according to claim 1, wherein the audio output device comprises a multimedia device for outputting audio content, in particular music or speech, or an engine audio signal generation device for outputting a noise made by a particular engine type.

16. The method according to claim 1, wherein the second EOC device is designed in a manner modeled on the first EOC device and has the same parameters as the first EOC device.

17. An apparatus for generating acoustic compensation signals, which are used to compensate acoustic signals that result from operation of a motor-vehicle drive engine, comprising:

a first engine order cancellation (EOC) device, which is designed to generate the acoustic compensation signals, which are used to compensate the acoustic signals that result from the operation of the motor-vehicle drive engine, wherein the first EOC device comprises at least one first audio capturing element and at least one audio output element, a second EOC device configured using the first EOC device as a model, wherein the second EOC device is modeled based on the first EOC device, represents a virtual copy of the first EOC device, and has the same functionality as the first EOC device, an audio output device, a determination device which is designed for determining at least one audio signal to be output into a passenger compartment of a motor vehicle by means of the audio output device, before the at least one audio signal is captured by the at least one first audio capturing element associated with the first EOC device, an evaluation device which is designed to apply an evaluation specification to evaluate the at least one audio signal with respect to at least one evaluation criterion, and to generate evaluation information which describes an evaluation of the at least one audio signal with respect to the at least one evaluation criterion, and a controller which is designed for controlling the operation of the first EOC device based on the evaluation information.

18. The apparatus according to claim 17, wherein the second EOC device is connected or formed between the audio output device and the first EOC device.

19. The apparatus according to claim 17, wherein the second EOC device comprises at least one second audio capturing element and an audio output element, wherein the audio output element is directly acoustically coupled to the at least one second audio capturing element.

20. The apparatus according to claim 17, wherein the second EOC device is designed in a manner modeled on the first EOC device and has the same parameters as the first EOC device.

* * * * *